United States Patent [19]

Rao et al.

[11] 3,987,594

[45] Oct. 26, 1976

[54] SYSTEM AND METHOD FOR AUTOMATIC UNSTOWING AND STOWING OF A CRANE BOOM

[75] Inventors: Kamlaker P. Rao, Aurora; William L. Lowe, Naperville; O. Thomas Nephew, Geneva, all of Ill.

[73] Assignee: Clark Equipment Company, Buchanan, Mich.

[22] Filed: Feb. 6, 1975

[21] Appl. No.: 547,679

[52] U.S. Cl. ..... 52/111; 212/144; 254/139.1; 52/118

[51] Int. Cl.[2] ..... E04H 12/34

[58] Field of Search ..... 52/111, 121, 116, 117, 52/114, 118, 143, 741; 254/139.1; 212/55, 70, 144

[56] References Cited

UNITED STATES PATENTS

| | | | |
|---|---|---|---|
| 3,109,523 | 11/1963 | Moller | 52/111 |
| 3,148,778 | 9/1964 | Fox | 212/70 |
| 3,190,457 | 6/1965 | Linden | 212/144 |
| 3,201,091 | 8/1965 | Woolslayer et al. | 254/139.1 |
| 3,664,516 | 5/1972 | Goudy | 212/144 |
| 3,698,569 | 10/1972 | Lamer | 212/144 |
| 3,831,771 | 8/1974 | Wiencek | 212/144 |
| 3,885,677 | 5/1975 | Görl et al. | 212/144 |
| 3,892,316 | 7/1975 | Holy | 212/144 |

*Primary Examiner*—Ernest R. Purser
*Assistant Examiner*—Robert C. Farber
*Attorney, Agent, or Firm*—Harry G. Thibault

[57] ABSTRACT

A system and method are disclosed whereby a crane boom assembly of relatively long length and large load carrying capacity may be automatically stowed and carried on the superstructure of a crane assembly. With the boom assembly in the stowed position, the boom and superstructure combination may be carried on a single truck and trailer combination for highway transport. Power driven means are provided for unstowing and stowing the boom assembly with respect to the superstructure. To unstow the boom assembly, first power driven means are provided to translate the boom forwardly with respect to the superstructure. Foot pins located at the rear of the boom assembly are mountable in the main pivot means on the superstructure of the crane when the boom assembly is fully extended forwardly of the superstructure to an intermediate unstowed position. Second power means are provided for automatically raising and lowering the fully extended boom assembly from a substantially horizontal intermediate unstowed position to a fully unstowed or inclined working position. Latching means associated with the boom foot pins are engaged when the boom assembly is pivoted upward to the inclined working position, thus firmly locking the boom assembly to the superstructure. To stow the boom, the boom is returned from the working position to the intermediate unstowed position, the latch means are disengaged, and the boom foot pins are removed. The second power means also translates the boom rearwardly with respect to the superstructure to the initial fully stowed position.

37 Claims, 11 Drawing Figures

SYSTEM AND METHOD FOR AUTOMATIC UNSTOWING AND STOWING OF A CRANE BOOM

BACKGROUND OF THE INVENTION

1. Field of the Invention

This invention relates to large material handling systems; more particularly, it relates to a system and method for unstowing and stowing a crane boom assembly relative to a superstructure mounted on the bed of a mobile crane.

A large mobile crane of the type with which the present invention is concerned typically includes a telescoping boom assembly having two or more extensible and retractable boom sections nested within a boom base section which is pivotably mounted on the superstructure of the crane.

In operation, the boom assembly is mounted on the superstructure for rotation about a horizontal axis. The telescoping boom assembly may be rotated to and locked at a potentially infinite number of inclined working positions which range from 0° to 80° with respect to the horizontal. The angle of inclination determines the height to which loads may be raised by the boom assembly. Typically, one or more nested telescoping sections of the boom assembly may be extended outwardly to further increase the working height of the boom.

When the boom is not in use, the boom sections are fully retracted to facilitate storage. However, with the boom assembly mounted on the superstructure, cranes of the size and weight considered herein commonly exceed the maximum length limit permitted on public highways. Thus, when it is necessary to transport the crane from one job site to another, it has been necessary to remove the boom assembly or a portion thereof from the superstructure for transport on a separate vehcile in order to avoid exceeding the maximum length limits permitted on public highways.

2. Known Systems

Typically, boom assemblies of the length and weight considered herein have been constructed in boom sections having divisible halves. Thus the boom assembly itself must be physically disassembled each time the boom is to be moved to a new job site. Two transport vehicles are necessary to carry the separable halves of the boom assembly to the new job site, and the boom must be re-assembled at the new job site.

A boom assembly of the length and weight considered herein may be of unitary construction. In such a instance it would normally be necessary to detach the boom assembly from the superstructure to meet maximum length requirements for public highways. Further, such boom assemblies would have to be transferred from the vehicle carrying the superstructure to a second vehicle for transport to the new job site. At the new job site, the boom assembly would have to be manually re-connected to the superstructure for operation of the crane. Further, the main pivot means between the boom and the superstructure, as well as winches, masts, cable assemblies and related apparatus necessary for the working operation of the crane would have to be manually disconnected and reconnected each time the crane is transported from place to place.

Thus it would be desirable if a system and method were provided which would enable the stowage of such a crane boom and its associated superstructure on a single transport vehicle.

Futher, it would be desirable if the boom assembly could be stowed and unstowed by means of an automatic system, to eliminate the manual disconnection and re-connection of the boom assembly and the superstructure, with resultant savings in stowage and unstowage time, and to reduce the necessity of contact of associated personnel with the crane assembly during the stowage and unstowage procedures, with resultant savings in manpower requirements.

Futher, it would be desirable to eliminate the need to disconnect winches, masts, cables and related apparatus necessary for the working operation of the crane when the boom assembly is stowed. To keep such apparatus in operative engagement with the boom assembly during the stowage period substantially decreases the setup time at the new job site, and virtually eliminates the human error inherent in the manual reconnection of such apparatus at the new job site.

Further, it would be desirable to provide positive locking means for securing the boom to the superstructure when the boom is mounted in the unstowed or inclined working position, to insure that the boom is locked to the superstructure when the boom is raised to the inclined working position.

The object of the present invention is to provide an improved system and method for unstowing and stowing the boom assembly associated with a crane superstructure.

A further object of the present invention is to provide a method for automatic unstowing and stowing of the telescoping boom assembly of a crane.

A further object of the present invention is to provide an improved system and method of unstowing and stowing the telescoping boom assembly of a material handling apparatus, the method eliminating the connection and disconnection of apparatus associated with the operation of the crane boom during the unstowing and stowing process.

Another object of the present invention is to provide positive locking means between the boom and the superstructure, when the boom is unstowed to an inclined or working position, to insure that the boom is locked to the superstructure when the boom is raised to a working position.

SUMMARY OF THE INVENTION

In the present invention, the fully retracted boom assembly is stowed in a position overlying the truck and trailer combination on which the crane superstructure is carried.

The superstructure of the crane is channel shaped with opposite longitudinal side portions of the channel extending upwardly. Boom supports having upper mounts or shoes so mounted on the supports to permit rockable movement of the mounts are placed in longitudinally spaced relationship within the channel along opposite inner side walls of the side portions in horizontally aligned opposing pairs. Substantially aligned tracks are provided on opposite inner side walls of the side portions of the boom superstructure and are vertically spaced above the boom support mounts. Axially aligned main boom pivot mounts are provided at an upper frontal portion of the superstructure in opposite side portions thereof. Aligned with the terminal portion of the tracks are a pair of boom foot pin stops appropriately mounted in respective alignment on opposite inner side walls of the side portions of the superstructure adjacent the main boom pivot mounts. First and second winches or hoists are suitably mounted in the superstructure of the crane. A gantry or support is provided on each side portions of the superstructure at respective upper rear portions thereof. A set of sheaves is rotatably mounted at respective upper ends of each gantry, the sheaves being in axial alignment.

The boom assembly comprises a plurality of boom sections correspondingly proportioned so that they slide telescopically in each other to provide a boom of appropriate length.

In the stowed position the boom sections are fully retractable with the boom assembly lying in the channel of the superstructure and carried on the boom support mounts. The boom assembly extends rearwardly of the superstructure to overlie the cab of the truck and trailer combination.

Extending rearwardly of a rear end portion of an outermost or boom base section of the boom assembly along respective sides of the boom base section are a pair of cam supports or carriers. At outer end portions of the cam carriers, rollers are suitably attached in axial alignment. Provided in the rear end portion of the boom base section adjacent the inner ends of the carriers are a pair of axially aligned boom foot pins extending horizontally outward from the sides of the boom base section. A hydraulic cylinder is provided inside the boom base section between the foot pins to extend and retract the boom foot pins. A spring-actuated latch means or mechanism includes a pair of latch bars which are engageable with the foot pins when the foot pins are extended outwardly and the boom assembly is raised.

Pivoted on an upper rear end portion of the boom base section is a mast assembly. The mast assembly comprises a pair of longitudinal rails overlying opposite side portions of the boom base section and pivotally secured to the boom base section at respective lower end portions of the rails. The rails may be secured together in any known manner. At the upper end of the mast assembly, the rails are connected by a mast pin which projects outwardly of the sides of the rails. Two sets of sheaves are rotatably mounted on respective opposite outward projections of the mast pin.

A cable having one end securely attached to the first hoist extends outwardly from the hoist to engage a sheave mounted on a rear or lower end portion of the boom base section of the boom assembly. The cable wraps around the sheave with the opposite end of the cable terminating at a dead end means by suitable attachment, the dead end means provided at a front or upper end portion of the boom base section of the boom assembly.

A boom lift cable assembly associated with the second hoist includes a cable suitably attached to the second hoist, the cable extending outwardly to engage the set of sheaves mounted on the first gantry on the side of the superstructure adjacent the second hoist. The cable is then cooperatively interconnected between the sheaves on the first gantry and the set of mast sheaves mounted on the mast pin on a first side of the mast and in alignment with the sheaves on the first gantry. The cable is then reeved from the sheaves on the gantry about two lower sheaves provided within the superstructure. The cable is then reeved upwardly to engage the set of sheaves carried on the second gantry mounted on the opposite side of the superstructure to be cooperatively reeved between the sheaves on the second gantry and a second set of sheaves mounted on the mast pin on a second side of the mast and in alignment with the sheaves of the second gantry. The outer end of the cable is secured to appropriate dead ending means provided on the superstructure.

Actuation of the first winch mechanism when the crane boom assembly is in the stowed position translates the boom assembly forwardly of the superstructure. During the translation of the boom assembly forwardly, the boom assembly is maintained in a substantially horizontal plane by a first guide means comprising the horizontally aligned boom support mounts or shoes and a second guide means comprising the rollers provided at the rear end portion of the boom assembly and the tracks complementary to the rollers provided along the inner side walls of the superstructure of the boom. As the rollers reach the terminal end of the track, the boom foot pins engage the foot pin stops on the inner side walls of the superstructure.

As the boom assembly is translated forwardly with respect to the superstructure, the sheaves mounted on the mast pin are longitudinally displaced from the sheaves mounted on the gantries mounted on the superstructure. The second hoist or winch is powered forwardly to play out the cable associated with the boom lift cable assembly.

With the foot pins in engagement with the stops, the boom is fully extended forwardly to an intermediate unstowed position. The hydraulic cylinder associated with the foot pins is actuated to extend the pins outwardly into the boom pivot mounts provided on the superstructure. With the foot pins in place the boom assembly is pivotably mounted on the superstructure in an operative mode.

To raise the boom to a fully unstowed or inclined working position, the second hoist is reversely powered to pivot the mast assembly about its lower end. The second hoist draws up the cable reeved between the sheaves on the gantries of the superstructure and the sheaves mounted on the mast assembly to draw the sheaves on the mast assembly toward the sheaves mounted on the gantries of the superstructure and thus rotating the mast assembly upward. As the mast assembly is rotated upward, a pair of cables each having one end portion thereof dead ended on the mast assembly and a second end portion dead ended on an upper end portion of the boom base section of the boom assembly on opposite sides thereof are drawn taut. After the cables are taut, further rotation of the mast assembly by the second hoist serves to rotate the boom assembly about the main pivot and thus raise the boom to an inclined or working position. As the boom is raised to the inclined working position, a stop on the superstructure in engagement with the latch mechanism of the foot pins is released to release the latch bars of the latch mechanism for engagement with the boom foot pins to latch the boom foot pins to the superstructure.

To return the boom to a stowed position, the second hoist, which engages the cable assembly operatively connected between the sheaves mounted on the first and second gantries attached to the superstructure and the sheaves mounted on the mast, is powered forwardly to lower the boom to the intermediate unstowed position. The latch mechanism is released, the boom foot pins are disengaged from the boom mounts, and the second hoist is powered in the reverse direction to retract the boom assembly in a substantially horizontal plane along the guide means to the fully stowed position.

Other features and advantages of the present invention will be apparent to persons skilled in the art from the following detailed description of a preferred embodiment and accompanied by the attached drawings wherein identical reference numerals will refer to like parts in the various views.

DESCRIPTION OF THE PREFERRED EMBODIMENT

Figure 1:
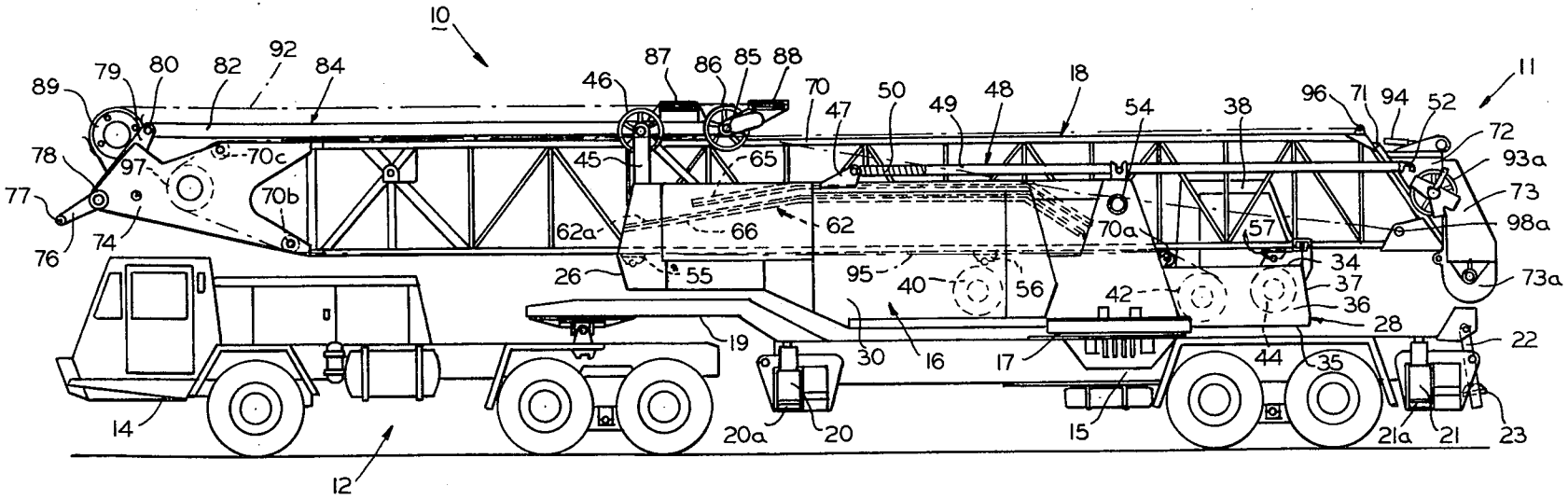
FIG. 1 is a side elevational view of a material handling apparatus incorporating the present invention with the apparatus in the stowed or transport position.
Figure 2:
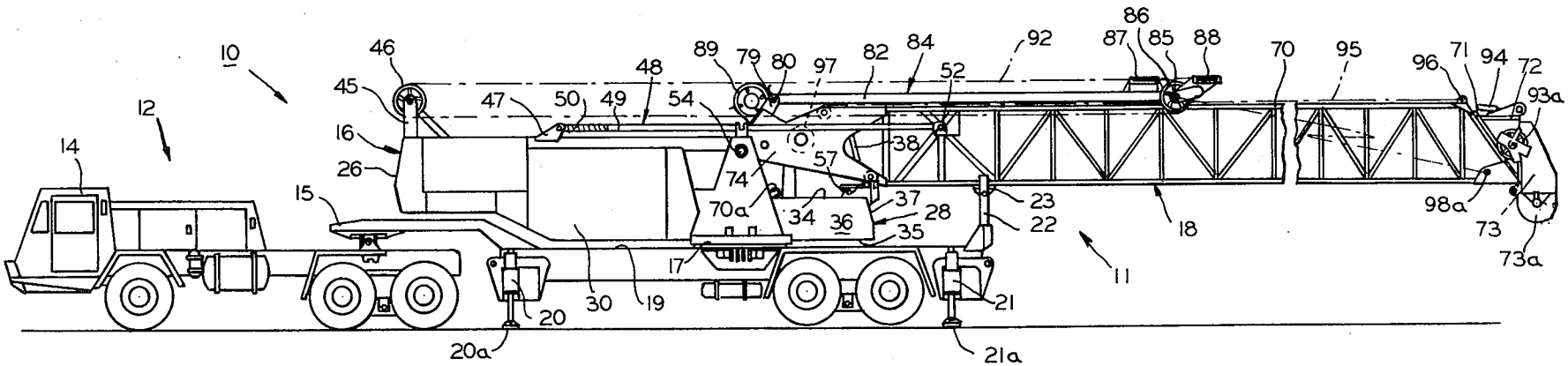
FIG. 2 is a side elevational view of the apparatus shown in FIG. 1 in reduced scale, with the telescoping boom assembly fully extended with respect to the superstructure, the boom assembly being shown in broken section to indicate the full forward extension of the boom with respect to the superstructure.

Referring to FIG. 1, reference 10 generally designates a large mobile material handling apparatus including a crane generally designated 11 mounted on a wheeled vehicle 12.

The vehicle 12 comprises a truck 14 and flatbed trailer 15 on which a crane superstructure 16 is mounted by means of a swing circle or slue ring generally designated 17. The swing circle 17 is provided with bearings to permit rotation of the superstructure 16 about a vertical axis.

Carried on the superstructure 16 is a boom assembly 18 comprising a series of extensible and retractable sections, each section being generally rectangular in cross section, and correspondingly proportioned so as to slide in each other to increase the working length of the boom.

The trailer bed 19 of the trailer 15 has appropriately mounted at opposite end portions thereof hydraulically actuated outriggers 20 and 21. Complementary outriggers (not shown) are also provided on the side of the trailer opposite the side shown in FIG. 1. The outriggers 20 and 21 are hydraulically actuated and are extensible and retractable outwardly of the trailer 15 in a generally horizontal plane. Respective foot portions 20*a* and 21*a* of the outriggers 20 and 21 are extensible and retractable in a substantially vertical plane to provide a firmly anchored, immovable support for the crane of the present invention.

A boom stow support 22 is pivotably mounted at the rear end of the trailer 15. The boom stow support 22 carries at the outer end thereof a pair of substantially horizontal support mounts or shoes 23 at opposite sides thereof.

Figure 5:
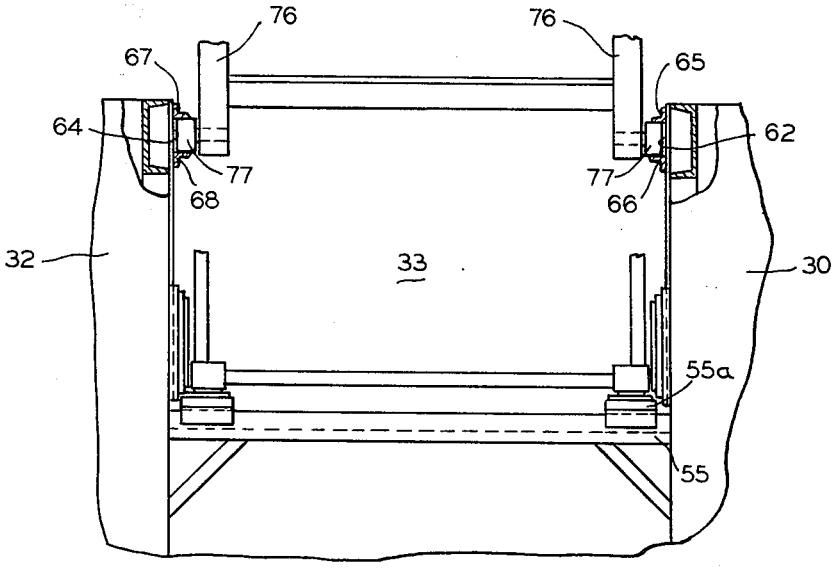
FIG. 5 is an enlarged partial view showing the rear end portion of the boom assembly and superstructure including the guide means provided on the superstructure, with portions of the superstructure and the boom assembly removed for clarity.
Figure 10:
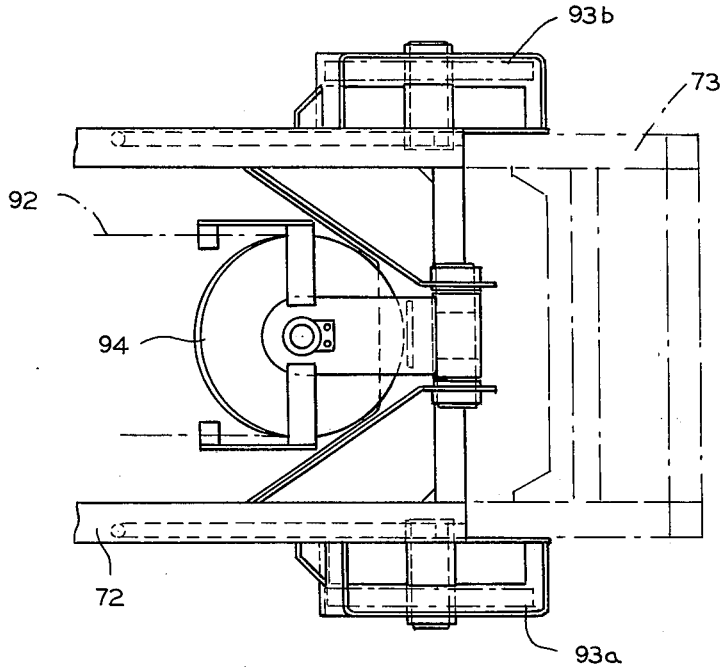
FIG. 10 is a top plan view of the view shown in FIG. 9.

The crane superstructure 16 comprises a main body portion 26, the main body portion comprising a base portion 28 and a pair of spaced upright side portions 30 and 32 (FIG. 5) mounted on the base portion 28, the side portions 30 and 32 disposed symmetrically on opposite sides of the longitudinal axis of the superstructure 16 to form a longitudinal channel 33 therebetween, the base portion 28 extending beyond the outer walls of portions 30 and 32.

The base portion 28 includes diagonal braces (not shown) welded to opposite inner walls of the side portions 30 and 32. The diagonal braces extend between the side portions 30 and 32 at the rear two-thirds of the superstructure 16. The base portion 28 also includes vertically spaced plates 34 and 35 welded between the side portions 30 and 32 at a frontal one-third of the superstructure. The plates 34 and 35 extend beyond the front of the side portions 30 and 32 and are enclosed by side plates 36 mounted forward of the main body portion 26 of the superstructure 16. The addition of side plates 36 to the plates 34 and 35 forms a boxlike forward extension 37 of the main body portion 26 of the superstructure 16. The upper plate 34 has an opening (not shown) therein to provide access to the interior of the extension 37. The forward extension 37 of the base portion 28 has mounted at one side thereof a crane operator's cab 38. The inner wall of the cab 38 is in substantial horizontal alignment with the inner wall of the side portion 32.

Appropriately mounted on the base of the superstructure 16 behind the cab 38 is a boom lift winch or hoist 40. The boom lift winch 40 is located at a midportion of the superstructure with the axes of rotation of the winch 40 perpendicular to the longitudinal axis of the superstructure and substantially horizontally aligned. An auxiliary winch or hoist 42 having its axis of rotation similarly aligned is appropriately mounted within the cavity of the forward extension 37 of the superstructure 16 and a similarly oriented load lift winch 44 is mounted forwardly of the auxiliary winch 42 in the forward extension 37 of the superstructure 16.

Respective support arms or gantries 45 are mounted on upper rear portions of the side portions 30 and 32 of the superstructure 16 and carry respective sets of sheaves 46 rotatably mounted thereon. Mounting plates 47 for a pair of spring loaded boom stops 48 are appropriately secured as by welding to respective upper edges of the side portions 30 and 32. Each boom stop 48 comprises a longitudinal rod 49 having a spring 50 located at a lower rear end portion thereof and a hook portion 52 located at an upper forward end portion of the boom stop 48. Axially aligned main boom pivot mounts 54 are provided on opposite side portions 30 and 32 of the superstructure 16.

Figure 4:
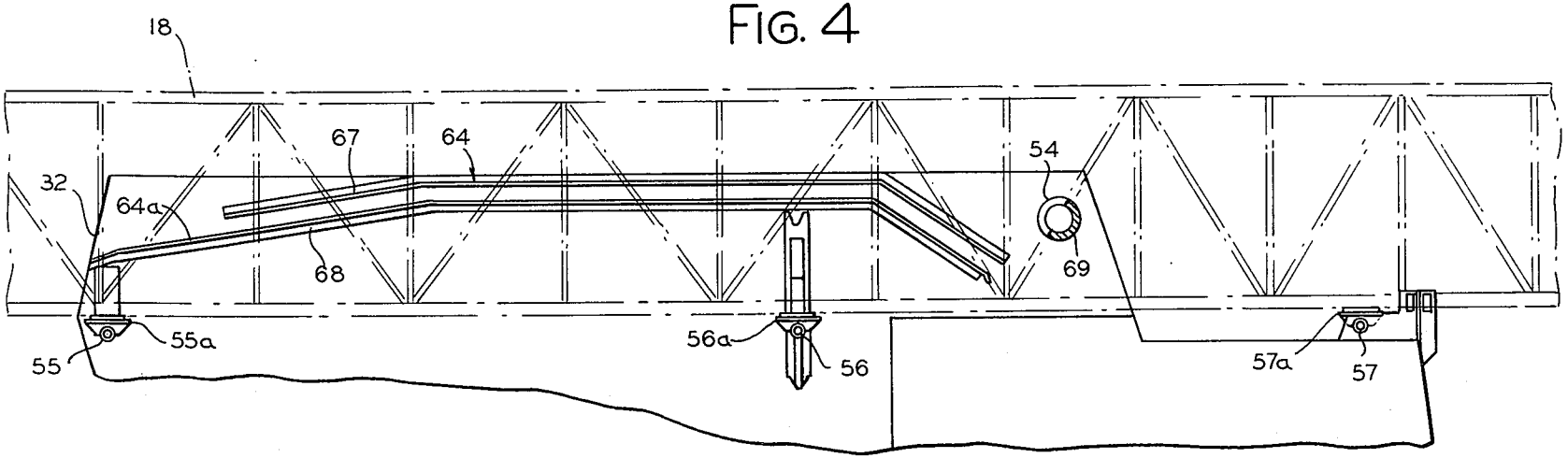
FIG. 4 is a side elevational view of the boom superstructure having the boom assembly mounted thereon, with certain parts removed or broken away for clarity and the crane boom assembly being shown in phantom.

As shown in FIG. 4, boom supports 55, 56 and 57 are provided along the base of the superstructure 16. The boom supports 55, 56 and 57 are secured to opposite inner side walls of the side portions 30 and 32 of the superstructure 16 in vertically aligned pairs. Rockable mounts or shoes 55*a*, 56*a* and 57*a* having substantially flat upper surfaces are appropriately secured to the respective boom supports 55, 56 and 57 at an upper portion thereof. The upper surfaces of the shoes 55*a*, 56*a* and 57*a* are generally aligned in a common horizontal plane. Horizontally aligned symmetric tracks 62 and 64, of generally trapezoidal configuration, are provided on opposite inner walls of the side portions 30 and 32 of the superstructure 16 for a purpose to be described later.

The track 62 comprises vertically spaced upper and lower rails 65 and 66. The rails 65 and 66 are L-shaped in cross-section, with a base leg of each L-shaped rail welded to the inner side wall of the side portion 30 of the superstructure 16. The track 64 is of like configuration and comprises vertically spaced, upper and lower L-shaped rails 67 and 68 having respective base legs secured in vertical spaced relation on the inner side wall of the side portion 32 of the superstructure 16. An initial upwardly sloping portion 62*a* of the track 62 comprises only the lower rail 66. The corresponding portion 64*a* of the rail 64 is similarly configured. Boom foot pin stops 69 are provided at respective terminal ends of the tracks 62 and 64 adjacent a peripheral frontal edge of the main boom pivot mounts 54. The foot pin stops 69 are projections of semi-circular cross-section extending outward of respective inner side walls of the side portions 30 and 32.

The boom assembly 18, which rests on the boom supports 55, 56 and 57 in the stowed position shown in FIG. 1 comprises a series of extensible and retractable sections, the sections being generally rectangular in cross-section, with the sections nested within each other. The boom sections are of known lattice type construction.

The sections are proportioned to slide in each other telescopically. The boom assembly 18 comprises a boom base section 70, a main boom section 71, an intermediate boom section 72, and a power outer or fly section 73 carrying a boom point or nose assembly 73*a*. The boom assembly 18 may be extended and retracted by any known means.

Figure 6:
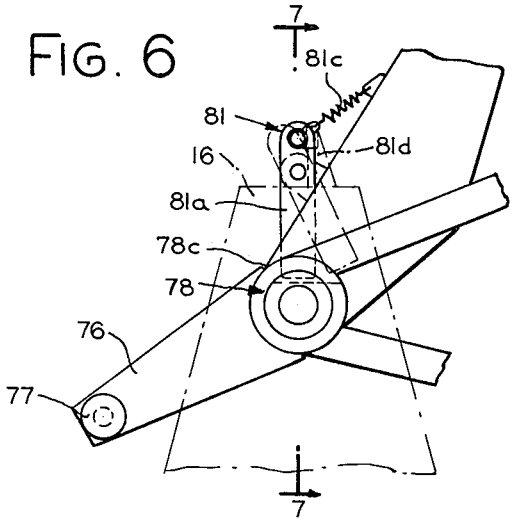
FIG. 6 is an enlarged detail view of the boom foot pin mechanism of the present invention including the latch mechanism for boom foot pins.

The boom base section 70 is tapered toward a rear end portion thereof. Opposite rear side plates 74 are welded to the frame of the boom base section 70. Extending rearwardly of the rear end portion of the boom base section 70 on opposite side walls thereof are a pair of cam carrying members 76. At an inner end of each cam carrying member 76 the member is secured to the rear end portion of the boom base section 70 of the boom assembly 18 and at the opposite end of each cam carrier 76 a rotatable cam or roller 77 is provided. Adjacent the inner ends of the cam carrier members 76 and carried within the boom base section 70 are a pair of boom foot pins 78 suitably mounted for extension and retraction with respect to side walls 74 at the rear of the boom base section 70. In the extended position, the outer ends of the foot pins 78 extend beyond opposite side walls of the boom assembly 18. As shown in FIG. 6, a hydraulic cylinder 75 is mounted between the boom foot pins 78.

Figure 7:
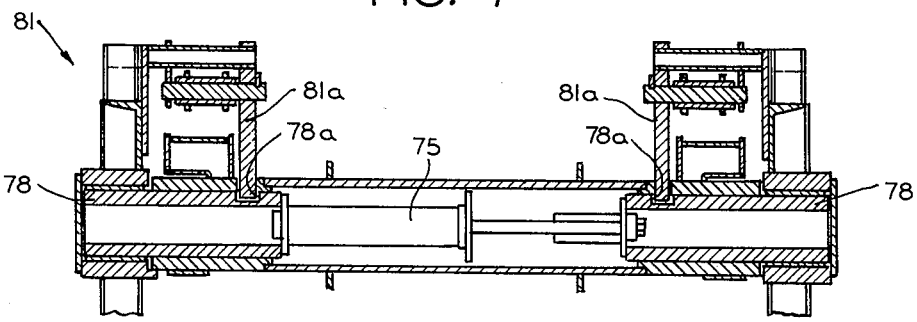
FIG. 7 is a sectional view taken generally along the line 7—7 in FIG. 6.

A latch mechanism 81 is associated with the boom foot pins 78 as shown in FIGS. 6 and 7. The latch mechanism 81 comprises a pair of latch bars 81*a* engageable with slots 78*a* in the boom foot pins 78. The latch bars 81*a* are secured to the latch mechanism 81 by respective tension springs 81*c* provided at upper ends of the latch bars 81*a*. As the boom is rotated upwardly, stops 81*d* on the superstructure 16 adjacent the latch mechanism 81 are disengaged from the latch bars 81*a* to snap the latch bars 81*a* into the slots 78*a* to the position shown in FIG. 7. When the boom is rotated downwardly, the stops 81*d* engage the latch bars 81*a* to push them out of the slots 78*a* to the position shown in FIG. 6 in phantom lines.

A pair of extensions 79 are secured to respective upper edges of the plates 74 of the boom base section 70 as by welding. Outer end portions of the gantries 79 have pivotal connections 80 wherein respective lower ends of side rails 82 of a longitudinal mast 84 are appropriately secured. The mast arms or rails 82 are secured in longitudinal alignment at the upper end thereof by a mast pin 85 which extends outwardly of the rails 82. Rotatable sheaves 86 are carried on opposite extensions of the mast pin 85 and in axial alignment therewith. Sheaves 87 and 88 are each single section sheaves appropriately secured to the upper end of the mast 84 with their respective axes of rotation perpendicular to the axis of rotation of the sheaves 86 and are provided for a purpose to be described later.

Figure 8:
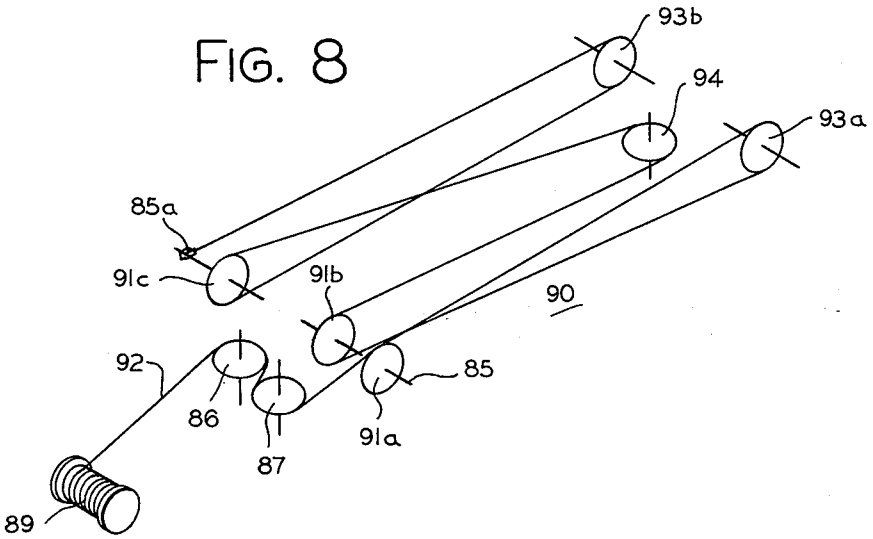
FIG. 8 is a schematic drawing of the cable assembly for the pendant hoist assembly.

Also provided at a rear lower end of the boom base section 70 is a pendant winch or hoist 89 appropriately secured to the boom base section 70 lying adjacent the boom foot pins 78 at an upper surface of the boom base section 70. Appropriately secured to the pendant hoist 89 is one end of a cable assembly 90 including a cable 92. The cable 92 is reeved about the sheaves 87 and 88 as shown in FIG. 8 and is then reeved about sheaves 91*a*, and 91*b* and 91*c* of a set of sheaves 91 mounted on the mast pin 85 in axial alignment with the sheaves 86 and then extended outwardly to reeve about single section sheaves 93*a*, 93*b* and 94 rotatably mounted on an outer end portion of the intermedaite boom section 72. The opposite end of the cable is terminated at a dead ending means 85*a* provided on the mast pin 85. The sheaves 91 are carried on the mast pin 85 and lie outside the arms 82 of the mast 84 and adjacent thereto with the sheaves 91 being freely rotatable about the mast pin 85.

Figure 9:
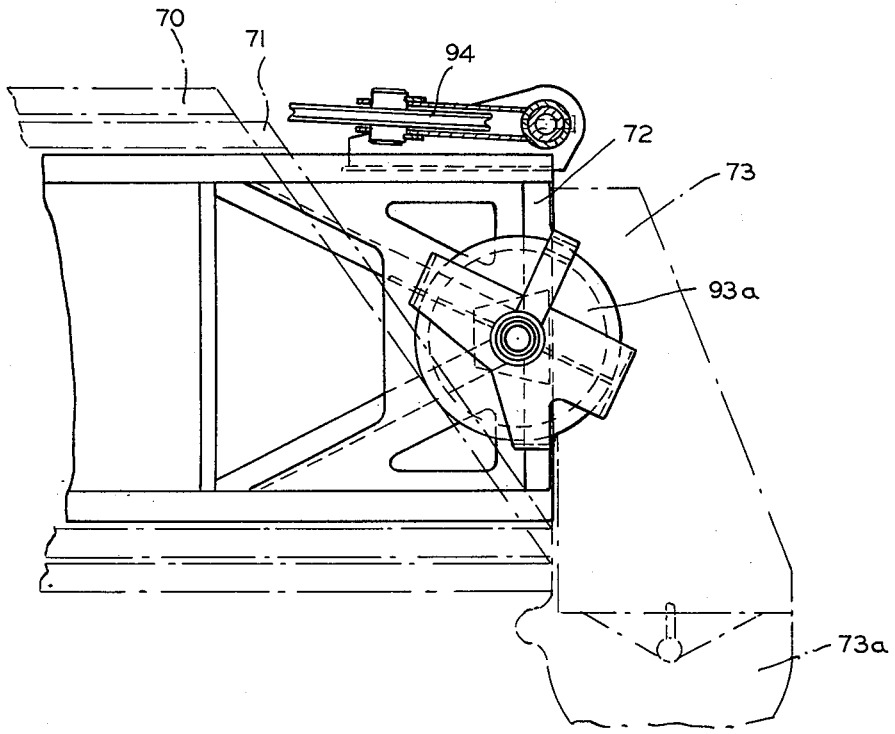
FIG. 9 is an enlarged detail view in side elevation of a front portion of an intermediate boom section of the crane boom assembly including part of the cable assembly for the pendant hoist assembly, with the boom sections adjacent the intermediate boom section being shown in phantom.

The sheaves 93*a* and 93*b* are mounted in axial alignment on opposite sides of the upper or front end portion of the intermediate boom section 72. The sheave 94 is pivotally mounted on top of the intermediate boom section 72 with its axis generally perpendicular to the axis of rotation of the sheaves 93*a* and 93*b* although the sheave 94 is shown slightly inclined wardly from the plane of the upper surface of the boom 18 at a rear edge thereof in FIG. 9.

Appropriately secured to the axiliary hoist 42 is one end of a cable 95 and secured to dead ending means 96 provided on the boom base section 70, the cable 95 being wrapped around a sheave 97 mounted within the boom base section 70 at a rear end portion thereof. Rollers 70*a*, 70*b* and 70*c* are mounted on the boom base section 70 as guide means for the cable 95.

Figures 3, 11:
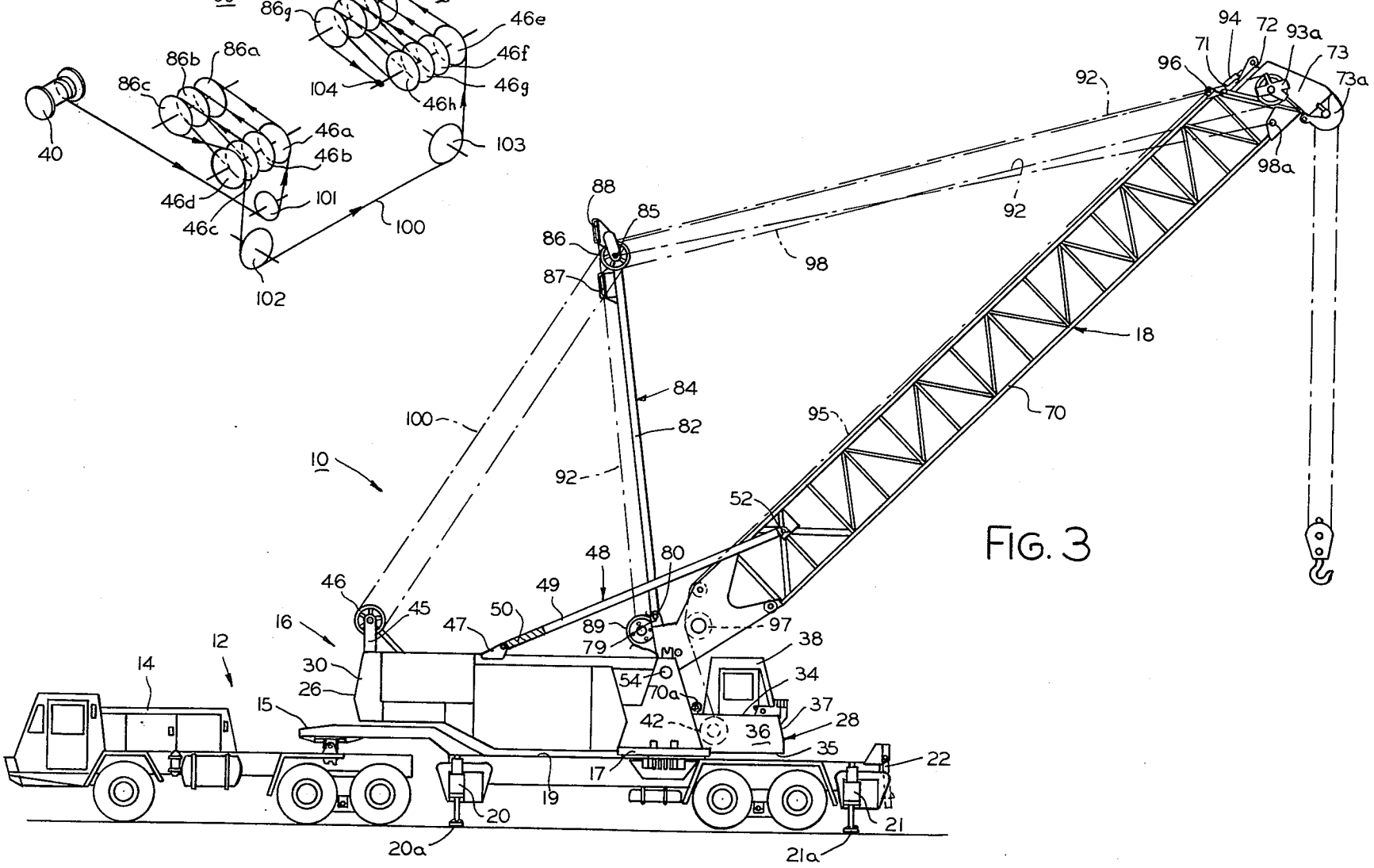
FIG. 3 is a side elevational view of the material handling apparatus of FIG. 2 with the boom assembly inclined upwardly to a fully unstowed or working position.
FIG. 11 is a schematic drawing of the cable assembly for boom lift apparatus.

As shown in FIG. 3, fixed pendant cables 98 are secured between the mast 84 and the boom base section 70 on opposite sides thereof. One end of each cable 98 is secured to the mast 84 at an upper end thereof and the opposite end of each cable 98 is secured to the boom at dead ending means 98*a* at a front or upper portion of the boom base section 70 of the boom assembly 18 as shown in FIG. 3.

A boom lift cable assembly 99 (FIG. 11) includes the boom lift hoist 40 which has a cable 100 suitably attached thereto, the cable extending outwardly about a lower sheave 101 to engage the set of sheaves 46 mounted on the first gantry 45 on the side portion 32 of the superstructure 16 and adjacent the boom lift 40. The cable 100 is then cooperatively interconnected between sheaves 46*a*, 46*b*, 46*c* and 46*d* of the first set of sheaves 46 on a first of the gantries 45 and sheaves 86*a*, 86*b* and 86*c* of the first set of sheaves 86 mounted on a first side of the mast 84 and in alignment with the sheaves 46 on the first gantry 45. The cable 100 is then reeved from the sheaves 46 on the first gantry 45 about two lower sheaves 102 and 103 provided within the superstructure 16. The cable 100 is then reeved upwardly to engage sheaves 46*e*, 46*f*, 46*g* and 46*h* of the second set of sheaves 46 carried on the second gantry 45 mounted on the opposite side of the superstructure 16 to be cooperatively reeved between the sheaves 46 on the second ganrty 45 and sheaves 86*d*, 86*e*, 86*f* and 86*g* of a second set of sheaves 86 mounted on a second side of the mast 84 and in alignment with the sheaves 46 of the second gantry 45. The outer end of the cable 99 is secured to appropriate dead ending means 104 provided on the superstructure 16.

In the stowed position shown in FIG. 1, the rear end portion of the boom base section 70 overlies a cab portion of the truck 14 and the front end of the boom outer section 73 overlies the rear portion of the flat bed trailer 15. The longitudinal axes of the boom assembly 18 and the superstructure 16 are substantially in alignment with the longitudinal axes of the truck 14 and the trailer 15.

OPERATION OF THE PREFERRED EMBODIMENT

In the stowed position the boom assembly 18 and the superstructure 16 of the crane 11 are generally aligned along the longitudinal axis of the truck and trailer combination 14, 15 and the front of the superstructure 16 faces the rear of the truck and trailer combination 14, 15. The boom assembly 18 rests in a substantially horizontal plane within the channel portion 33 of the superstructure 16 and is carried by boom supports 55, 56 and 57 and rests on boom support mounts 55*a*, 56*a* and 57*a*.

To move the boom assembly 18 from the stowed or transport position shown in FIG. 1 to the fully unstowed or erect working position shown in FIG. 3, the following sequence of steps must be taken.

Outriggers 20 and 21 are hydraulically extended in a horizontal plane to the outer limit of their travel. The foot portions 20*a* and 21*a* of each outrigger 20 and 21 is then hydraulically extended downwardly to lift the crane 11 and is associated flat bed trailer 15 off the trailer wheels to provide an immovable and firmly anchored support for the superstructure of the crane 11.

With the superstructure 16 immovably anchored the auxiliary hoist 42 is actuated to draw up the cable 95 wrapped about the sheave 97 rotatably mounted in the boom base section 70 of the boom assembly 18 at a rear portion thereof. Rollers 70*b* and 70*c* carried on the boom base section 70 at an end portion thereof guide the cable 95 about the sheave 97. As the cable 95 is drawn up on the auxiliary hoist 42, the cable 95 engages the sheave 97 and a substantial force is exerted on the boom assembly 18 through the sheave 97 so as to translate the boom assembly 18 forwardly with respect to superstructure 16. The boom support mounts 55*a*, 56*a* and 57*a* maintain the boom assembly in a substantially horizontal plane during the translation of the boom assembly forwardly.

As the boom assembly 18 is translated forwardly, the rotatable sheaves 46 carried on the support arms or gantries 45 mounted on the superstructure 16 remain stationary and the sheaves 86 mounted on the mast pin 85 at the upper end of the mast 84 are translated forwardly as the mast 84 is part of the boom assembly 18. The boom lift winch 40 operatively connected to the cable assembly 99 is powered forwardly as the boom 18 is translated forwardly. However, as the boom 18 is translated forwardly the boom lift winch 40 merely plays out the cable 100 of the cable assembly 99 and the longitudinal separation of the stationary sheaves 46 and the movable sheaves 86 increases.

After the boom assembly 18 has been translated forwardly 5 or 6 feet so that the nose assembly 73*a* of the boom 18 is clear of the rear of the trailer bed 15, the boom stow support 22 is pivoted upwardly to firmly seat on the rear end portion of the trailer 15 with boom stow mounts 23 on the upper end of the boom stow support 22 engaging the bottom of the boom assembly 18 to carry the weight of the boom assembly 18 as it is translated further forwardly. As the cable 95 is drawn onto the hoist 42 the boom 18 continues to translate forwardly on the boom supports 55, 56 and 57 and the boom stow support 22 along a generally horizontal plane.

As the rear end portion of the boom assembly 18 reaches the rear end portion of the superstructure 16 the rollers 77 mounted on the cam carriers 76 engage initial upwardly sloped portions 62*a* and 64*a* of the horizontally aligned tracks 62 and 64. As the hoist 42 continues to draw up the cable 95 to translate the boom assembly 18 forwardly, the rollers 77 guide the boom assembly 18 up the initial slope 62*a* and 64*a* of the tracks 62 and 64 to slightly incline the boom 18 downwardly. The boom support mounts 55*a*, 56*a* and 57 rock about their respective supports to smoothly effect the transfer of the weight of the boom assembly 18 from rear supports 55 and 56 to the rollers 77, to the front boom support 57, and to the boom stow support 22. Along the upper horizontal portion of the aligned tracks 62 and 64, the boom assembly 18 is inclined slightly downwardly as it is translated forwardly. As the boom assembly 18 nears the end of its travel forwardly the terminal portions of the tracks 62 and 64 are inclined downwardly. The rollers 77 descend the terminal portion of the tracks 62 and 64 until the boom foot pins 78 engage foot pin stops 69 provided adjacent the main boom pivot mounts 54. When the foot pins 78 engage the boom foot pin stops 69 the boom assembly 18 can no longer be translated forwardly. The boom is restored to a generally horizontal orientation. With the boom 18 fully extended forwardly, the hooks 52 of the boom stops 49 engage rods provided on the boom 18. The hydraulic cylinder 75 between the foot pins 78 is activated to extend the foot pins into the main boom pivot mounts 54. When the foot pins 78 are fully extended into the main boom mounts 54, the boom foot pin latch mechanism 81 is engageable so as to lock the foot pins 78 in place.

With the foot pins in place, the boom assembly 18 is in a fully translated forward position and may be readily raised to a fully unstowed or working position.

The boom assembly 18 is raised to the fully unstowed or working position as follows.

The boom lift winch 40 is reversely powered to draw the cable 100 into the winch 40 and thus raise the mast 84. The mast 84 pivots at a lower end thereof about the supports 79 on the rear end portion of the boom base section 70 of the boom assembly 18. The sheaves 86 carried on the mast pin 85 and cooperatively connected with the sheaves 46 mounted on the gantries 45 are engaged by the cable 100 of the cable assembly 99 associated with the boom lift winch 40. As the cable 100 is drawn up into the boom lift winch 40, the mast 84 is pivoted about its lower end to an inclined position with respect to the boom assembly 18. The angular separation between the mast 84 and the boom base assembly 18 is limited by the weight bearing pendant cables 98 of fixed length each having one end securely attached to the upper end of the mast 84 and an opposite end securely attached to an upper end of the boom base section 70 of the boom assembly 18. When the fixed pendant cables 98 are taut, further drawing up of the cable 99 by the boom lift winch 40 raises the boom assembly 18 to an inclined working position. Through the use of the boom lift winch 40 the angle of inclination of the boom assembly 18 may be rotated from the horizontal or 0° to a maximum of 80°, with the ability to fix the boom assembly 18 at any angular inclination within that range to optimize working conditions within the load limits of the crane. The boom stops 49 limit the angle of inclination of the working boom to 80°. When the boom is raised, the boom stow support 22 is rotated downwardly and out of the way.

The purpose of the pendant hoist 89 mounted on the rear end of the boom assembly 18 on the boom base section 20 is to automatically extend the variable pendant cable 92 which is a subsidiary supporting member of the boom assembly 18. As the mast 84 is raised the pendant winch or hoist 89 is idle and the variable pendant cable 92 is played out through the sheaves 87, 88 and 91 mounted on the mast pin 85 and the sheaves 93 and 94 on the intermediate boom section 72. When the boom assembly 18 is finally inclined at a fixed working position, the pendant hoist 89 is powered to draw the variable pendant cable 92 taut and thus distribute the weight of the load between the fixed pendant cables 98 and the variable pendant cable 92. Because the boom assembly 18 comprises a series of telescoping sections which may be extended and retracted by any appropriate means, the variable pendant cable 92 will be automatically played out as the various boom sections are extended. When the extended boom 18 has reached its working length the pendant winch 89 may again be activated to readily facilitate the distribution of the weight of the boom assembly 18 between the fixed pendant 98 and the variable pendant 92.

To stow the boom assembly 18, the fully extended boom assembly 18 is retracted to a fully retracted position with the sections of the boom assembly 18 nested within each other. The boom stow support 22 on the rear end of the trailer 15 is raised to the upper position. The boom lift winch 40 is forwardly powered to play out the cable 100 of the cable assembly 99 and lower the boom assembly 18. When the boom assembly 18 is fully lowered to rest on the boom stow support 22, the auxiliary hoist 42 is shut down. The fixed pendant cables 98 remain attached to the mast 84 and the boom assembly 18 but are stowed on the boom assembly 18. The mast 84 is lowered by forwardly powering the winch 40 to release the boom lift cable 100, the mast 84 pivoting forwardly to rest on the upper surface of the boom assembly 18. The variable pendant cable 92 is drawn onto the pendant hoist 89 as the boom lift cable 100 is let out to aid in lowering the mast 84. When the mast 84 is fully lowered to overlie the boom assembly 18, the pendant winch 89 takes up the variable pendant cable 92 and a latch is set on the pendant winch 89 to aid in retaining the mast 84 in generally horizontal alignment with respect to the boom assembly 18 as the boom 18 is returned to the fully stowed or transport position. When the mast 84 is in horizontal alignment adjacent the upper surface of the fully lowered boom assembly 18, the hooks 52 of the boom stops 48 are disengaged from the boom 18. The boom latch mechanism 81 is deactivated to release the latch bars 81*a*. With the latch bars 81*a* disengaged, the hydraulic cylinder 75 is activated to retract the boom foot pins 78 from the boom pivot mounts 54 of the superstructure 16.

With the boom foot pins 78 disconnected from the boom pivot mounts 54, the boom lift winch 40 is reversely powered to draw up the cable 100. The axes of sets of sheaves 46 and 86 lie in a substantially horizontal plane, and because the foot pins 78 have been disconnected from the main boom pivot mounts 54, the boom assembly 18 is free to move rearwardly. As the cable 100 is taken up by the boom lift winch 40 the boom assembly 18 is translated in a rearward direction with respect to the superstructure along the boom supports 55, 56 and 57 and the upper tracks 62 and 64 in a manner similar to that described for the forward translation of the boom, but, of course, in the opposite direction. When the boom assembly 18 is fully translated rearwardly a stop on the boom engages a stop on the superstructure and the boom 18 has been returned to the fully stowed or transport position shown in FIG. 1.

It can be seen from the above description that a large mobile material handling apparatus such as the crane 11 may be easily transported on a single vehicle from job site to job site without a need to manually disassemble the crane when it must be moved and reassemble the crane on the new job site. The stowing and unstowing of the boom assembly is achieved by the system herein described without the need for substantial manual assistance.

Having thus described in detail a preferred embodiment of the invention, persons skilled in the art will be able to modify certain of the structure as illustrated and substitute equivalent elements for those which have been disclosed, and it is, therefore, intended that all such modifications and substitutions be covered as they are embraced within the spirit and scope of the appended claims.

I claim:

1. For a large material handling apparatus including a crane superstructure and a crane boom assembly, a system for unstowing and stowing the boom assembly with respect to the superstructure, the system comprising:

means provided on the superstructure for supporting the boom assembly when the boom assembly is in an initial stowed position, the boom assembly including a boom foot portion at one end thereof and a boom nose portion at an opposite end thereof, said boom foot portion disposed remotely from the crane superstructure when the boom assembly is mounted thereon in the stowed position, first power means for translating the crane boom assembly from the stowed position to an intermediate unstowed position, the boom foot portion disposed adjacent the superstructure when the boom assembly is in the intermediate unstowed position, guide means for maintaining the orientation of the boom assembly as it is translated from a stowed position to an intermediate unstowed position, means for pivotally mounting the boom assembly on the superstructure when the boom assembly has been translated from the stowed position to the intermediate unstowed position, and second power means for lifiting the boom from the intermediate unstowed position to a fully unstowed or inclined working position, said second power means also being operable to return the boom assembly from the intermediate unstowed position to the initial stowed position.

2. A system as claimed in claim 1 wherein the first power means includes a hoist suitably mounted on the superstructure, and a cable assembly operatively connected between the hoist and the boom assembly.

3. A system as claimed in claim 1 wherein the second power means includes a hoist suitably mounted on the superstructure and a cable assembly operatively connected between the hoist and the boom assembly.

4. A system as claimed in claim 2 wherein the cable assembly of the first power means includes a sheave rotatably mounted within the boom assembly at a rear end portion thereof, dead ending means, and a cable having opposite ends, one end of the cable being operatively connected to the hoist, the cable cooperatively interconnected between the hoist, the sheave mounted on the boom assembly, and the dead ending means, so as to be engageable with the boom assembly when the hoist is powered in a first direction to draw up the cable.

5. A system as claimed in claim 3 wherein the cable assembly associated with the second hoist includes a first set of sheaves rotatably mounted in fixed relation with respect to the superstructure, a second set of sheaves rotatably mounted on the boom assembly and in movable relationship with respect to the sheaves on the superstructure, dead ending means, and a cable having opposite ends, one end of the cable being operatively connected to the second hoist, the opposite end of the cable terminating at the dead ending means, the cable being cooperatively interconnected between the sheaves on the superstructure and the sheaves on the boom assembly between opposite end portions thereof.

6. A system as claimed in claim 1 wherein the means for lifting the boom from the intermediate unstowed position to the fully unstowed or inclined working position includes a mast assembly pivotally mounted on the boom assembly.

7. A system as claimed in claim 6 wherein the boom assembly comprises an elongate assembly having elongate top, bottom, and opposite side portions, the mast assembly comprising one or more longitudinal rails secured in fixed relation and overlying the top portion of the boom assembly and in substantial alignment with the longitudinal axis thereof, respective rear or lower ends of the rails being pivotally mounted on the rear or lower end of the boom assembly, a cable having opposite end portions, a first end portion of the cable secured to appropriate dead ending means at an upper end of the mast and a second end portion of the cable appropriately secured to dead ending means on the boom assembly, and means for pivoting the mast with respect to the boom assembly.

8. A system as claimed in claim 7 wherein the means for pivoting the mast assembly comprises a hoist associated with the second power means, the hoist being mounted on the superstructure, a cable assembly associated with the second hoist, said cable assembly operatively connected between the hoist of the second power means and the mast assembly.

9. A system as claimed in claim 8 wherein the cable assembly comprises a first set of sheaves rotatably mounted in fixed relation with respect to the superstructure, a second set of sheaves rotatably mounted on an upper end portion of the mast assembly, dead ending means, and a cable having opposite ends, one end of the cable being operatively connected to the second hoist, the opposite end of the cable being connected to the dead ending means, the cable being interconnected between the sheaves on the superstructure and the sheaves on the mast assembly between opposite end portions thereof.

10. A system as claimed in claim 9 wherein the second power means to translate the boom from the intermediate stowing position to a fully stowed or working position includes third power means mounted on a lower or rear end position of the boom assembly and a cable assembly operatively connected between the third power means and a front or upper portion of the boom assembly.

11. A system as claimed in claim 1 wherein the second power means to translate the boom from the intermediate unstowed position to a fully stowed or working position includes third power means mounted on a lower or rear end portion of the boom assembly and a cable assembly operatively connected between the third power means and a front or upper end portion of the boom assembly.

12. A system as claimed in claim 11 wherein the third power means comprises a pendant hoist mounted on a rear or lower end portion of the boom, and the cable assembly includes a first set of sheaves associated with the third power means and mounted at a mid portion of the boom assembly, a second set of sheaves mounted at a front or upper portion of the boom assembly and associated with the third hoist, dead ending means, and a cable having opposite ends, with one end thereof operatively connected to the pendant hoist, an opposite end thereof connected to the dead ending means, the cable being cooperatively interconnected between said first and second sets of sheaves associated with the pendant hoist between opposite end portions thereof.

13. For a large material handling apparatus or crane including a crane superstructure and a crane boom assembly, a system for unstowing and stowing the boom assembly with respect to the superstructure, the system comprising:

means provided on the superstructure for supporting the boom assembly when the boom assembly is in an initial stowed position, the boom assembly including a boom foot portion at one end thereof, and a boom nose portion at an opposite end thereof, said boom foot portion disposed remotely from the crane superstructure when the boom assembly is mounted thereon in the stowed position, first power means for translating the crane boom assembly from the stowed position to an intermediate unstowed position, the boom foot portion disposed adjacent the superstructure when the boom assembly is in the intermediate unstowed position, guide means for maintaining the orientation of the boom assembly as it is translated from a stowed position to an intermediate unstowed position, means for pivotally mounting the boom assembly on the superstructure when the boom assembly has been translated from the stowed position to the intermediate unstowed position, and second power means for returning the boom assembly from the intermediate unstowed position to the initial stowed position.

14. For a large material handling apparatus including a crane superstructure and a crane boom assembly, the boom assembly having a boom foot portion at one end thereof and a boom nose portion at an opposite end thereof, a system for unstowing and stowing the boom assembly with respect to the superstructure, the system comprising:

first power means for translating the boom assembly from an initial stowed position, wherein the boom foot portion is disposed remotely, from the superstructure, to an intermediate unstowed position, wherein the boom foot portion is disposed adjacent the superstructure, second power means for lifting the boom from the intermediate stowed position to a fully unstowed position, the second power means including means for translating the boom from the intermediate unstowed position to the initial stowed position, the second power means comprising a hoist mounted on the superstructure, a cable assembly operatively connected between the hoist and the boom assembly, said cable assembly including a first set of sheaves rotatably mounted on the superstructure, a second set of sheaves rotatably mounted on the boom assembly, the set of sheaves on the boom assembly being in movable relationship with respect to the superstructure, dead ending means, and a cable having opposite ends, one end of the cable being operatively connected to the second hoist, and an opposite end of the cable being connected to the dead ending means, the cable being cooperatively interconnected between the first set of sheaves on the superstructure and the second set of sheaves on the boom assembly between opposite ends thereof.

15. A system as claimed in claim 14 wherein the boom assembly includes a mast assembly, the mast assembly comprising one or more longitudinal members having opposite ends, the longitudinal members being aligned in spaced fixed relation and being pivotally mounted at a lower or rear end thereof at a lower or rear end of the boom assembly, said second set of sheaves being mounted at an upper or front end of the mast assembly and a cable of fixed length having opposite end portions, one end portion of the cable secured to an upper end portion of the mast assembly and the opposite end portion of the cable secured to the boom assembly, whereby when the mast assembly is pivoted about the boom assembly, the fixed cable is drawn taut so as to maintain the set of sheaves on the mast assembly in fixed relation with respect to the boom assembly.

16. For a large material handling apparatus including a superstructure and a crane boom assembly, a system for unstowing and stowing the boom assembly with respect to the superstructure, the system comprising:

first power means for translating the boom assembly from an initial stowed position to an intermediate unstowed position, second power means for rotating the boom from the intermediate unstowed position to a fully unstowed or inclined working position, said second power means including a hoist suitably mounted on a rear or lower portion of the boom assembly and a cable assembly operatively connected between the hoist on the boom assembly and an upper end portion of the boom assembly.

17. A system as claimed in claim 16 wherein the upper end portion of the boom assembly is extensible with respect to the lower end portion of the boom assembly.

18. A system as claimed in claim 17 wherein the cable assembly comprises a first set of sheaves mounted on a lower portion of the boom assembly, a second set of sheaves mounted on the upper extensible portion of the boom assembly, dead ending means on the boom assembly, the cable having opposite end portions, one end portion operatively connected to the hoist mounted on the rear end portion of the boom assembly, the opposite end portion of the cable connected to the dead ending means, the cable being cooperatively interconnected between said first and second sets of sheaves between opposite end portions thereof.

19. A system as claimed in claim 1 wherein the means for supporting the boom assembly includes a portion of the superstructure, the superstructure comprising a body portion having a base portion and spaced opposite sides portions forming a channel on the superstructure, the boom assembly lying on the base portion of the superstructure in the channel formed on the superstructure when the boom assembly is in the stowed position, each side portion of the superstructure having respective inner and outer side walls, and the mounting means comprising boom support members secured to opposite inner side walls of the superstructure and having their respective upper surfaces generally aligned in a common horizontal plane.

20. A system as claimed in claim 19 wherein the boom support members include upper mount or shoes, said shoes being rockable about respective upper end portions of the support members mounted in aligned pairs on respective opposite inner side walls of the superstructure, the shoes having substantially flat upper surfaces which are generally aligned to provide a first guide means for the boom assembly.

21. A system as claimed in claim 1 wherein the guide means comprises a first guide means on the superstructure, a second guide means on the crane boom assembly, said first and second guide means being in cooperative engagement during at least an initial portion of the translation of the boom from a stowed position to an intermediate unstowed position.

22. A system as claimed in claim 21 wherein the superstructure comprises a channel-shaped body portion having spaced side portions, including respective inner and outer walls thereof, the first guide means comprises a linear rail extending longitudinally of an inner wall of a first side portion of the superstructure, and the second guide means comprises a roller rotatably mounted on the boom assembly and engageable with the rail on the wall of the superstructure.

23. A system as claimed in claim 22 wherein the first guide means comprises a first linear rail mounted on an inner side wall of a first side portion of the superstructure, a second linear rail mounted on an opposite inner side wall of a second side portion of the superstructure, said first and second linear rails extending longitudinally with respect to the superstructure in substantially horizontal alignment.

24. A system as claimed in claim 23 wherein the second guide means comprises a pair of rollers axially aligned and mounted on opposite sides of the boom assembly, said rollers being cooperatively engageable with the linear rails when the boom is translated horizontally with respect to the superstructure.

25. A system as claimed in claim 24 wherein the linear rails each comprise first and second portions, said first and second portions being vertically spaced on the inner wall of the superstructure whereby the roller on the boom assembly is guided between said upper and lower portions of the linear rails as the boom is translated horizontally with respect to the superstructure.

26. A system as claimed in claim 1 wherein the superstructure includes opposite side portions, and the means for pivotally mounting the boom assembly on the superstructure comprises boom pivot mounts provided in axial alignment on opposite side portions of the superstructure, a pair of boom foot pins in axial alignment carried on opposite sides of the boom assembly, and means between inner ends of said boom foot pins operable to extend the foot pins into the boom pivot mounts when the foot pins are aligned with the boom pivot mounts.

27. A system as claimed in claim 26 wherein the means for pivotally mounting the boom assembly on the superstructure includes boom foot pin stops adjacent the boom pivot mounts and engageable when the boom is translated to the intermediate unstowed position.

28. A system as claimed in claim 27 wherein the means for operating the foot pins is a hydraulic cylinder connected between inner ends of the foot pins operable to extend and retract the foot pins to connect and disconnect the boom assembly from the superstructure.

29. A system as claimed in claim 28 wherein the mounting means also includes a latch mechanism operable when the boom foot pins are extended into the boom mounts so as to lock the boom foot pins in an extended position to lock the boom assembly to the superstructure.

30. A system as claimed in claim 29 wherein the foot pins include slots therein, and the latch mechanism includes latch bars engageable in said slots.

31. A system as claimed in claim 30 wherein the latch bars are spring loaded and the latch mechanism includes a stop on the superstructure engageable with the latch bars, said stop disengaged to permit the latch bars to spring into the slots on the foot pins when the boom is rotated from an intermediate horizontal position to the fully unstowed or inclined working position, said stops engaged with the latch bars to rotate the latch bars out of the slots when the boom assembly is rotated from the inclined position to the horizontal position.

32. For a large material handling apparatus including a crane superstructure and a crane boom assembly, a method for unstowing and stowing the boom assembly with respect to the superstructure, the superstructure having means for carrying the boom assembly when the boom assembly is in a stowed position, the boom assembly including a boom foot portion at one end thereof and a boom nose portion at an opposite end thereof, said boom foot portion disposed remotely from the crane superstructure when the boom assembly is mounted on the superstructure in the stowed position, and guide means for maintaining the orientation of the boom assembly as it is translated from a stowed positon to an intermediate unstowed position, the boom foot portion disposed adjacent the superstructure when the boom assembly is in the intermediate unstowed position, the method comprising the steps of:

providing first power means, providing second power means, providing means for pivotally mounting the boom assembly on the superstructure, translating the boom assembly from the initial stowed position to the intermediate unstowed position using said first power means, and translating the boom from the intermediate unstowed position to the intital stowed position by said second power means.

33. For a large material handling apparatus including a crane superstructure and a crane boom assembly, a method for unstowing and stowing the boom assembly with respect to the superstructure, the superstructure having means for carrying the boom assembly when the boom assembly is in a stowed position, the boom assembly including a boom foot portion at one end thereof and a boom nose portion at an opposite end thereof, said boom foot portion disposed remotely from the crane superstructure when the boom assembly is mounted on the superstructure in the stowed position, and guide means for maintaining the orientation of the boom assembly as it is translated from a stowed position to an intermediate unstowed position, the boom foot portion disposed adjacent the superstructure when the boom assembly is in the intermediate unstowed position, the method comprising the steps of:

providing first power means, providing second power means, providing means for pivotally mounting the boom assembly on the superstructure, translating the boom assembly from an initial stowed position to an intermediate unstowed position using said first power means, pivotally mounting the boom assembly on the superstructure when the boom assembly has been translated from the stowed position to the intermediate unstowed position using said mounting means, lifting the boom from the intermediate unstowed position to a fully unstowed or inclined working position by said second power means, lowering the boom from the inclined working position to the intermediate unstowed position by said second power means, and translating the boom from the intermediate unstowed position to the initial stowed position by said second power means.

34. The method of claim 33 further comprising steps of providing a mast assembly on the boom assembly, the mast assembly lying adjacent to the boom assembly and rotatable with respect thereto, providing a cable of fixed length having one end secured to the mast assembly and an opposite end secured to the boom assembly, rotating the assembly away from the boom mast assembly through the second power means so as to draw the cable taut, and further actuating the second power means so as to lift the boom from the intermediate unstowed position to the fully unstowed or inclined working position through the mast assembly.

35. The method of claim 34 further comprising the steps of providing a third power means mounted on a lower or rear end portion of the boom assembly, providing a cable assembly operatively connecting the third power means and a front or upper end portion of the boom assembly, the cable assembly including a cable operatively connected between the third power means and the upper end portion of the boom, and actuating the third power means so as to draw the cable taut when the boom has been raised to an inclined working position to provide support for the boom assembly.

36. The method of claim 35 further comprising the steps of actuating the second power means in the reverse direction so as to lower the boom from the fully stowed or inclined working position to the intermediate unstowed position, further actuating the second power means in the reverse direction to rotate the mast assembly toward the boom assembly, and actuating the third power means when the mast assembly is lying adjacent the boom assembly to retain the mast assembly in adjacent realtionship with the boom assembly as the boom assembly is translated rearwardly to the initial stowed position.

37. A system as claimed in claim 33 including the steps of providing boom pivot mounts in axial alignment on the superstructure, providing boom foot pins in axial alignment on opposite sides of the boom assembly, providing means between inner ends of the boom foot pins actuable to extend the boom foot pins into the boom pivot mounts when the foot pins and the boom mounts are axially aligned.

* * * * *